US010993862B2

(12) United States Patent
Stroh et al.

(10) Patent No.: US 10,993,862 B2
(45) Date of Patent: May 4, 2021

(54) EXTENDABLE FLUID CONDUIT FOR RECONFIGURABLE BED

(71) Applicants: Glenn C. Stroh, Marion, TX (US); Randall P. Kelch, San Antonio, TX (US); Kenneth M. Knowles, Bandera, TX (US); HUNTLEIGH TECHNOLOGY LIMITED, Dunstable (GB)

(72) Inventors: Glenn C. Stroh, Marion, TX (US); Randall P. Kelch, San Antonio, TX (US); Kenneth M. Knowles, Bandera, TX (US)

(73) Assignee: HUNTLEIGH TECHNOLOGY LIMITED, Dunstable (GB)

( * ) Notice: Subject to any disclaimer, the term of this patent is extended or adjusted under 35 U.S.C. 154(b) by 356 days.

(21) Appl. No.: 15/505,081

(22) PCT Filed: Aug. 18, 2015

(86) PCT No.: PCT/US2015/045711
§ 371 (c)(1),
(2) Date: Feb. 18, 2017

(87) PCT Pub. No.: WO2016/028794
PCT Pub. Date: Feb. 25, 2016

(65) Prior Publication Data

US 2017/0273842 A1 Sep. 28, 2017

Related U.S. Application Data

(60) Provisional application No. 62/038,716, filed on Aug. 18, 2014.

(51) Int. Cl.
*A61G 7/015* (2006.01)
*A61G 7/005* (2006.01)
(Continued)

(52) U.S. Cl.
CPC ..... *A61G 7/015* (2013.01); *A61G 7/002* (2013.01); *A61G 7/005* (2013.01); *A61G 7/05* (2013.01);
(Continued)

(58) Field of Classification Search
CPC ..... A61G 7/015; A61G 7/002; A61G 7/005; A61G 7/05; A61G 7/0506; A61G 7/0755;
(Continued)

(56) References Cited

U.S. PATENT DOCUMENTS 4,525,885 A 7/1985 Hunt et al.
5,279,010 A * 1/1994 Ferrand ..... A61G 7/00 5/507.1

(Continued)

FOREIGN PATENT DOCUMENTS

JP 2001292865 A 10/2001
JP 3152947 U 7/2009

(Continued)

OTHER PUBLICATIONS

Written Opinion of International Application No. PCT/US2015/045711 dated Nov. 23, 2015.

(Continued)

*Primary Examiner* — Nicholas F Polito
*Assistant Examiner* — Morgan J McClure
(74) *Attorney, Agent, or Firm* — The Webb Law Firm

(57) ABSTRACT

A patient support system including a frame having first and second portions, at least one of them movable with respect to the other to transition the frame between a first configuration and a second configuration. A first port is coupled to the first portion of the frame, and a second port disposed with the second portion of the frame, such that a distance between the first port and the second port changes when the frame transitions between the first and second configura-
(Continued)

tions. A fluid conduit is arranged between the first port and the second port and configured to transition between a first length and a second length, longer than the first length, when the frame is transitioned between the first and second configurations. The fluid conduit is configured with a resiliency to naturally return toward the first length. A method of using a patient support system is also included.

17 Claims, 6 Drawing Sheets

(51) Int. Cl.

| | |
|---|---|
| ***A61G 7/05*** | (2006.01) |
| ***A61G 7/075*** | (2006.01) |
| ***A61G 7/002*** | (2006.01) |
| ***A47C 27/08*** | (2006.01) |
| ***A47C 27/10*** | (2006.01) |
| ***A47C 19/04*** | (2006.01) |
| ***A61G 7/057*** | (2006.01) |

(52) U.S. Cl.
CPC ..... *A61G 7/0506* (2013.01); *A61G 7/0755* (2013.01); *A47C 19/04* (2013.01); *A47C 27/08* (2013.01); *A47C 27/082* (2013.01); *A47C 27/083* (2013.01); *A47C 27/10* (2013.01); *A61G 7/05769* (2013.01)

(58) Field of Classification Search
CPC ..... A61G 7/05769; A61G 7/05776; A47C 19/04; A47C 19/045; A47C 27/082; A47C 27/083; A47C 27/08; A47C 27/10
See application file for complete search history.

(56) References Cited

U.S. PATENT DOCUMENTS

| | | | | |
|---|---|---|---|---|
| 6,701,552 | B2 | 3/2004 | Suzuki et al. | |
| 9,038,218 | B1 * | 5/2015 | Heil | A61G 5/006 5/618 |
| 2006/0168728 | A1 * | 8/2006 | Strobel | A61G 7/05 5/618 |
| 2006/0242765 | A1 * | 11/2006 | Skripps | A61G 13/04 5/621 |
| 2008/0276375 | A1 * | 11/2008 | Gehrke | A47C 20/021 5/648 |
| 2011/0131725 | A1 | 6/2011 | Stroh et al. | |
| 2017/0209320 | A1 * | 7/2017 | Lo | A61G 7/015 |

FOREIGN PATENT DOCUMENTS

| | | | |
|---|---|---|---|
| JP | 2013513434 | A | 4/2013 |
| WO | 2011071899 | A2 | 6/2011 |

OTHER PUBLICATIONS

ISR and Written Opinion of International Application No. PCT/US2015/045711 dated Nov. 23, 2015.

* cited by examiner

EXTENDABLE FLUID CONDUIT FOR RECONFIGURABLE BED

CROSS-REFERENCE TO RELATED APPLICATIONS

This U.S. non-provisional application is a nationalization, pursuant to 37 C.F.R. § 371, of international patent application no. PCT/US2015/045711, filed on Aug. 18, 2015, which in turn claims benefit of priority to U.S. provisional application No. 62/038,716, filed on Aug. 18, 2014, all the foregoing applications of which are incorporated by reference in their entirety herein.

BACKGROUND

Patient support systems, such as hospital beds, are well known in the healthcare industry. Some beds, particularly for long term care of patients, include inflatable support surfaces, e.g., mattresses. In order to control inflation of a mattress, a fluid pressure supply unit may be included, e.g., mounted to the footboard of the bed frame (e.g., formed with or separately attached to the footboard), and connected to the mattress via one or more fluid conduits. It is often desired for the beds to be reconfigurable between two or more configurations (e.g., laid flat, reclining, etc.) to improve patient comfort and to facilitate patient care. One solution to provide a reconfigurable bed with an inflatable mattress and fluid supply unit has been to include an excess length of the fluid conduit, such that fluid conduit can accommodate different frame configurations. However, this excess length may dangle under the bed or need to be coiled on the floor under the bed, which may be considered unsightly, cumbersome, or complicate the motion of working components of the bed during reconfiguration.

SUMMARY

Patient support systems are disclosed herein. In one embodiment, a patient support system includes a frame having a first portion and a second portion, at least one of the first portion or the second portion movable with respect to the other to transition the frame between a first configuration and a second configuration. A first port is coupled to the first portion of the frame, and a second port disposed with the second portion of the frame, such that a distance between the first port and the second port changes when the frame transitions between the first and second configurations. A fluid conduit is arranged between the first port and the second port and configured to transition between a first length and a second length, longer than the first length, when the frame is transitioned between the first and second configurations. The fluid conduit is configured with a resiliency to naturally return toward the first length.

In one embodiment, the patient support system further comprises a fluid pressure supply unit configured to communicate fluid pressure through the fluid conduit. In one embodiment, the first portion of the frame comprises a footboard and the fluid pressure supply unit is mounted to the footboard and in fluid communication with the fluid conduit via the first port. In one embodiment, the fluid pressure supply unit includes the first port. In one embodiment, the frame includes a telescoping member coupled to the footboard and configured to enable the frame to elongate in order to transition the frame between the first and second configurations.

In one embodiment, the second portion of the frame includes a mattress deck. In one embodiment, the patient support system further includes a mattress supported on the mattress deck and in fluid communication with the fluid conduit via the second port. In one embodiment, the mattress deck comprises a plurality of portions that are configured to articulate with respect to each other to transition the frame between the first and second configurations.

In one embodiment, the first portion of the frame comprises a mattress deck. In one embodiment, the mattress deck comprises multiple portions that are configured to articulate with respect to each other to transition the frame between the first and second configurations.

In one embodiment, the patient support system comprises a bed. In one embodiment, a length of the fluid conduit is configured to be extendable up to at least about two times an unstressed configuration. In one embodiment, the fluid conduit comprises a plurality of convolutions. In one embodiment, the convolutions are arranged in an axially adjacent manner to form the fluid conduit. In one embodiment, an axial dimension of each of the convolutions is variable in response to different forces exerted on each of the convolutions, which variable axial dimension enables the fluid conduit to transition between the first length and the second length.

Methods of using a patient support system are also disclosed herein. In one embodiment, a method of using a patient support system includes configuring a frame of the patient support system by causing relative movement between a first portion and a second portion of the frame in order to transition the frame between a first configuration and a second configuration. A distance between a first port disposed with the first portion of the frame and a second port disposed with the second portion of the frame is changed due to the transition between the first and second configurations. A length of a fluid conduit arranged between the first port and the second port is changed when the frame is transitioned between the first and second configurations, wherein the fluid conduit is arranged to naturally return toward an initial length after tensile forces exerted on the fluid conduit are relieved. Maintaining fluid communication between the first port and the second port via the fluid conduit after changing the length of the fluid conduit.

In one embodiment, the first portion is connected to the second portion by a telescoping member that is movable with respect to the second portion, and reconfiguring the frame includes elongating the frame by moving the first portion and the second portion away from each other via the telescoping member. In one embodiment, the first portion includes a footboard of the frame and a fluid pressure supply unit mounted to the footboard. In one embodiment, the patient support system further includes a joint coupled to the first portion and wherein reconfiguring the frame includes articulating the first portion relative to the second portion. In one embodiment, the patient support system further includes a mattress deck that is at least partially comprised by the first portion.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
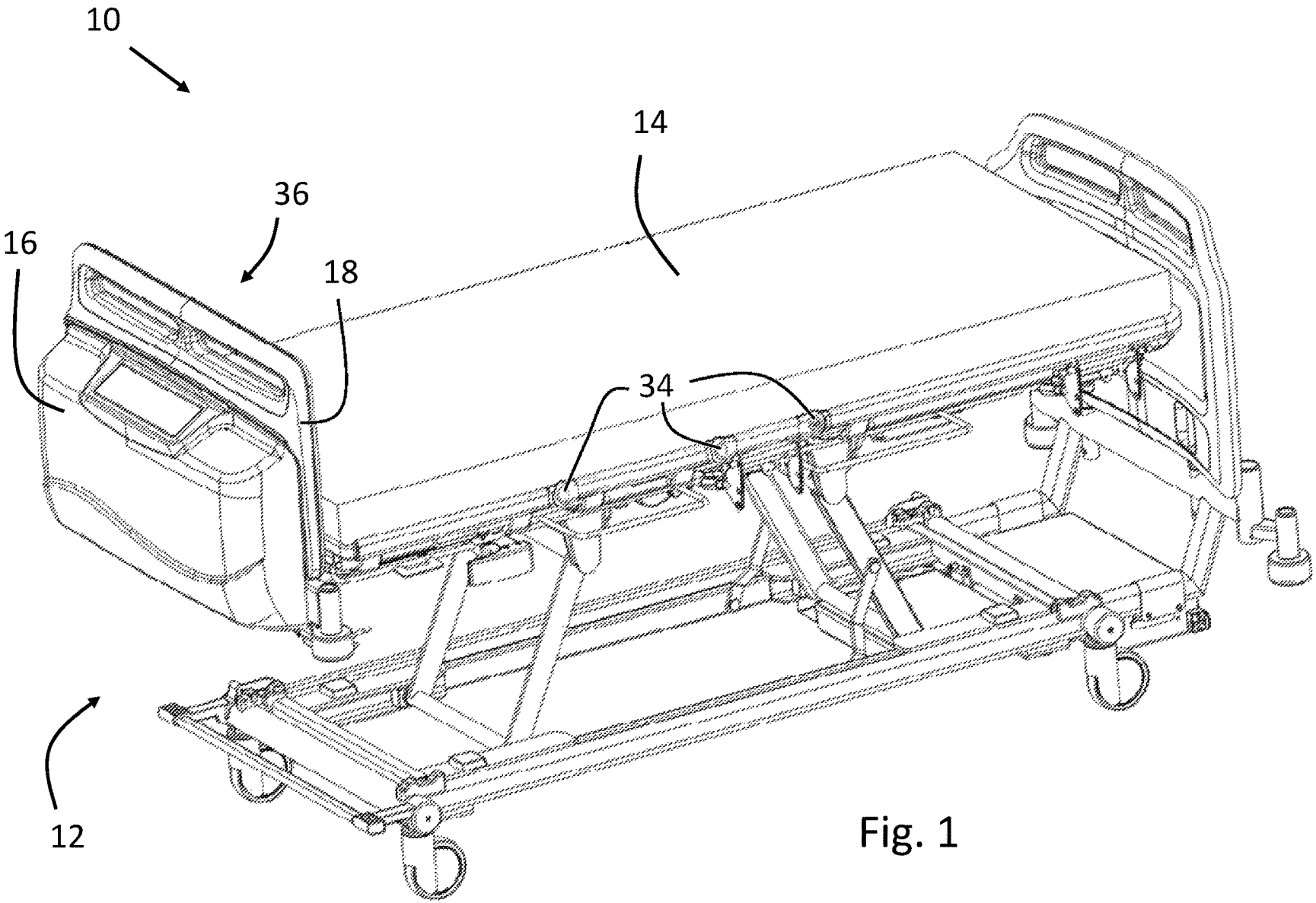
FIG. 1 is a perspective view of a patient support system according to an exemplary embodiment disclosed herein.

A detailed description of one or more embodiments of the disclosed apparatus and method are presented herein by way of exemplification and not limitation with reference to the Figures.

A patient support system 10 is shown in FIGS. 1-2 and 5-7. In this illustrated embodiment, it can be seen that the patient support system 10 may take the form of a bed for facilitating the care of a patient. However, it is to be understood in view of the disclosure herein that the patient support system 10 may take other forms, such as a chair, couch, etc. As shown in the illustrated embodiment, the patient support system 10 may include a frame 12, an inflatable mattress 14, and a fluid pressure supply unit 16, each discussed in more detail below.

In many respects, the frame 12, the inflatable mattress 14, and the fluid supply unit 16 may generally take the form of frames, mattresses, and fluid supply units known, used, or discovered in the art. For example, the frame 12 may be arranged to enable lengthwise elongation, tilting, and/or articulation of all or a portion of various sections thereof, or any other form of reconfiguration. The mattress 14 is illustrated schematically in FIGS. 1 and 2, and it is understood that the mattress 14 may be or include a single large inflatable cell or compartment, individual cells or compartments that all are fluidly fully or partially isolated from each other, groups of cells or compartments that are in fluid communication within each group, but fluidly isolated from other groups, etc. The fluid pressure supply unit 16 may be detachably or permanently mounted to the frame 12, e.g., at or to a footboard 18 or headboard, and may include a blower, fan, pump or other pressure source 17 capable of generating, sustaining or otherwise communicating fluid pressure.

In order to communicate fluid pressure between the fluid pressure supply unit 16 and the mattress 14, and thereby inflate and subsequently control the inflation level or fluid pressure within the mattress 14, one or more fluid conduits 20 are provided. In the illustrated embodiment, a set of ten fluid conduits 20 are illustrated, although it is to be understood that any other number can be provided. For example, multiple fluid conduits 20, (e.g., the ten shown in FIG. 2), may be provided such that each of the fluid conduits 20 independently correspond to a different cell or compartment within the mattress 14. It is also to be understood that multiple cells or compartments within the mattress 14 may be in communication with a single fluid conduit 20, or multiple ones of the fluid conduits 20 may be in communication with a single one of the cells or compartments of the mattress 14.

As illustrated in FIGS. 2 and 5-7, the fluid conduits 20 (shown schematically in FIGS. 5-7) are connected at one end to one or more ports 24 in fluid communication with the fluid pressure supply unit 16, (e.g., an outlet for the pressure supply unit 16), and at the opposite end to one or more ports 26 in fluid communication with the mattress 14 (e.g., an inlet port and/or part of an inlet manifold assembly 28, at least a part of which is integral with or optionally connectable to the mattress 14). It is to be understood that the ports 24 and 26 may be formed in, with, or comprise, any coupling, elbow, nozzle, manifold, etc. that is securable to the opposing ends of the fluid conduits 20 and is connected or connectable or couplable directly or indirectly to the frame 12, such that fluid communication is provided between the ports 24 and 26 via the fluid conduits 20. In one embodiment, the ports 24 are outlet ports formed within the pressure supply unit 16, and the ports 26 are inlet ports formed within the manifold assembly 28, while in another embodiment, the ports 24 and/or 26 are formed by couplings between the fluid conduit 20 and the fluid pressure supply unit 16 and/or the mattress 14. In this way, fluid pressure can be communicated from the fluid pressure supply unit 16, out through the port 24, through the fluid conduits 20 and to the mattress 14 via the ports 26 in order to control the level of inflation of the mattress 14.

Figure 3:
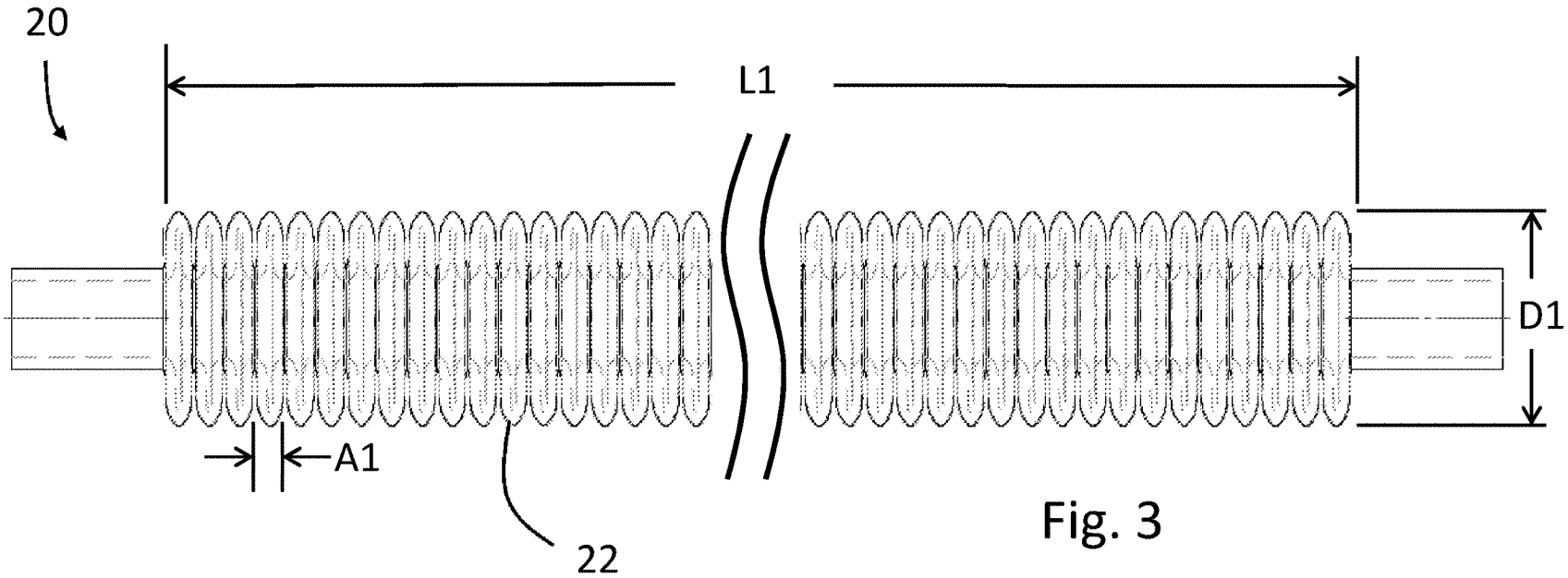
FIG. 3 is side view of an extendable fluid conduit according to the exemplary embodiment disclosed herein in an unstressed (e.g., relaxed or retracted) configuration.
Figure 4:
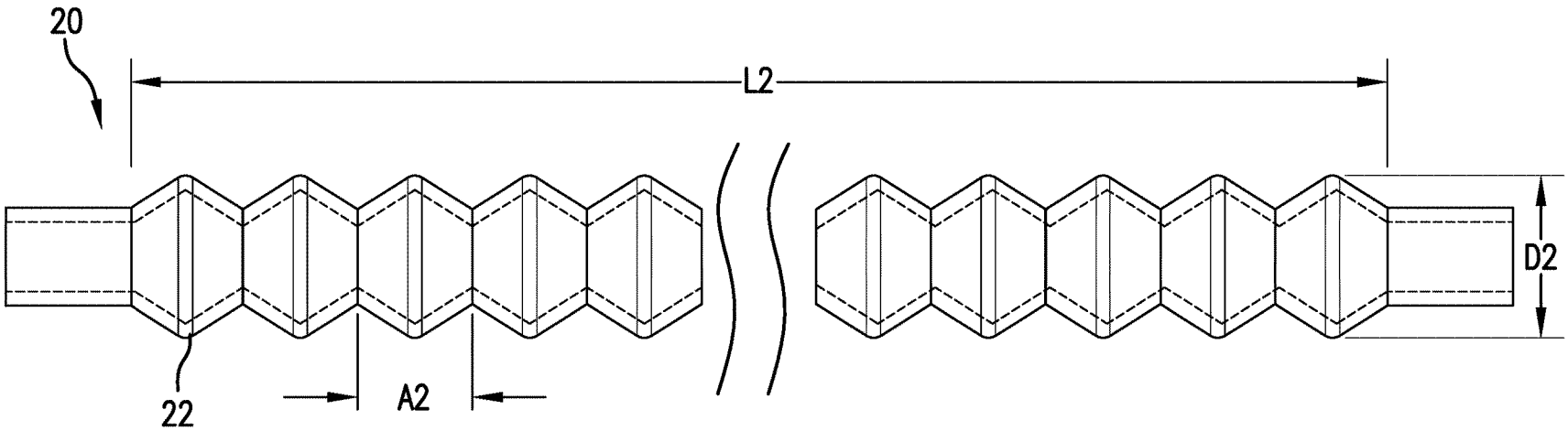
FIG. 4 is a side view of the extendable fluid conduit of FIG. 3 in an extended configuration.

One embodiment for the fluid conduit(s) 20 is shown in more detail in FIGS. 3 and 4. The fluid conduit 20 is shown in FIG. 3 in an unstressed retracted (i.e., non-extended) configuration and in FIG. 4 in an at least partially expanded, extended, or otherwise stretched configuration, preferably maintained in tension. The fluid conduit 20 has a first length L1 when in the retracted configuration, and a second length L2, greater than the first length L1, when in an extended configuration. For example, a tensile stretching force applied to the opposite ends of the fluid conduit 20 may be used transition the fluid conduit between the retracted and extended configurations. It is to be appreciated that the length L2 represents just one possible length for the fluid conduit 20 to take, and that the fluid conduit 20 may be variably stretched to other lengths as desired. The fluid conduits 20 are thus referred to herein as each having a variable axial dimension; that is, the axial dimension of the fluid conduits can change, e.g., due to tensile forces applied to the fluid conduit, in order to enable the fluid conduits 20 to change in axial length.

In one embodiment, the fluid conduit(s) can stretch at least about two to five times a minimum length of the fluid conduit 20, the minimum length determined when the fluid conduit 20 is in an unstressed (i.e., little to no externally applied forces, although the material may be under some degree of internal stresses) or fully retracted configuration (e.g., as shown in FIG. 3, discussed below). In order to enable this change in length, the fluid conduit(s) 20 may be formed from any suitable material having an elongation factor suitable to provide the above-noted at least about two to five times increase in length. In order for the fluid conduits 20 to maintain fluid communication as described above, the fluid conduits 20, in both the unstressed and stretched configurations, must also be capable of holding or accommodating a predetermined fluid pressure to be communicated by the fluid pressure supply unit 16 to the mattress 14. In one embodiment, the fluid pressure requirement of the fluid conduits 20 is between about 2-90 mmHg, e.g., depending on the compartment of the mattress 14 being inflated, the needs or physiology of the patient, etc.

In some embodiments, such as the embodiment illustrated in FIGS. 3 and 4, the fluid conduit 20 includes a plurality of convolutions 22 along its length. The convolutions 22 are arranged to "close", contract or otherwise "bunch up" adjacent to each other when the fluid conduit 20 is in the retracted configuration, e.g., as shown in FIG. 3 with each of the convolutions 22 having an axial dimension A1. The convolutions 22 can be any twist or fold that provides excess material. When a tensile stretching force is applied to the fluid conduit 20, the convolutions will be pulled away from each other, or "opened up", which causes the previously bunched up material of the convolutions 22 to extend longitudinally in the axial or longitudinal direction, e.g., as shown in FIG. 4 with the convolutions having an axial dimension A2 significantly greater than the initial dimension A1. In this way, the convolutions 22 may be generally understood to function similar to the pleats in a bellows or accordion.

To better understand the mechanism by which the convolutions 22 operate, the inner luminal surface as well as the resulting wall thickness and inner profile of the fluid conduit 20 can be appreciated by way of hidden lines in FIGS. 3 and 4. The diameter of the fluid conduit 20 is also indicated in FIGS. 3 and 4 with the reference numerals D1 and D2, respectively. It can be seen that the diameter D1 of the fluid conduit 20 in its initial configuration is relatively larger than the diameter D2 after the fluid conduit 20 has been at least partially stretched. That is, the lengthening of the fluid conduits 20 may in some embodiments be not so much accomplished by stretching the material of the convolutions 22, but rather, the arrangement or angularity of the walls of the convolutions 22 may be changed. In the retracted configuration, the walls of the convolutions 22 are arranged substantially perpendicularly with respect to the axis of the fluid conduit 20. Transition to the extended configuration causes the walls of the convolutions 22 to become increasingly aligned along or made parallel with respect to the axis of the fluid conduit 20. This reorientation of the angularity of the walls of the convolutions 22 with respect to the axis of the fluid conduit 20, e.g., initially perpendicular to the axis of the fluid conduit 20 and then increasingly aligned parallel to the axis, results in the diameter of the convolutions to decrease (e.g., from diameter D1 to D2), as the axial dimension increases (e.g., from dimension A1 to A2). Thus, the fluid conduit 20 may generally resemble a tube of consistent wall thickness when stretched to its absolute maximum length.

In an exemplary embodiment, the axial dimension of each of the convolutions 22 may increase by up to about two to five times when the fluid conduit 20 is transitioned from the retracted configuration to the expanded configuration. This helps achieve a corresponding overall increase in length of the fluid conduits 20 of at least about up to about two to five times the initial length, although it is to be appreciated that other degrees of elongation for the fluid conduits 20 are contemplated and possible.

It is to be appreciated that any number of the convolutions 22 may be included. Additionally, while the convolutions 22 are shown in FIGS. 3 and 4 as separate segments sequentially arranged along the conduit's axis and adjacent to each other, it is to be appreciated that in other embodiments the convolutions 22 may be formed differently. For example, in one embodiment, one or more convolutions are formed in a spiral, corkscrew, or helix pattern circumferentially about, and extending radially from, a central tubular structure.

In addition to enabling expansion up to multiple times its initial length, the fluid conduit 20 may also be configured to naturally return to its retracted configuration. That is, for example, the fluid conduit 20 may be formed from any suitable elastically deformable material, such that the fluid conduit 20 will resiliently, springingly, and/or elastically return to its retracted configuration, e.g., as shown in FIG. 3, when tensile stretching forces on the fluid conduit 20 are relieved. For example, the fluid conduit 20 may be manufactured in one embodiment by molding or forming the fluid conduit 20 from an elastic material in its retracted configuration. In this way, the elasticity of the material forming the fluid conduit 20 will cause the fluid conduit 20 to naturally return to this initial, retracted configuration. In one embodiment, the fluid conduit 20 may be manufactured from ethylene propylene diene monomer (EPDM) rubber, although other elastomers, polymers, or combinations thereof may suffice. In a further embodiment, the EPDM rubber has a Shore A hardness of between about 40-90, more particularly between about 50 and 70, and even more particularly about 60. In one embodiment, a coil spring or other spring element or elements may be embedded within or disposed with the walls of the fluid conduit 20 to facilitate the natural return to the retracted configuration. The natural resiliency of the fluid conduits 20 and corresponding bunching of the convolutions 22 towards each other provides buckling resistance to the fluid conduits 20 even when there is little or no tension applied thereto.

Advantageously, the ability of the fluid conduits 20 to change in length due to the convolutions 22 enables the fluid communication provided by the fluid conduits to be maintained even if the components connected to the opposite ends of the fluid conduits (e.g., the fluid pressure supply unit 16 and the manifold assembly 28, or other components in which the ports 24 and 26 are formed or mounted), are moved relative to each other. Thus, due to the variable length of the fluid conduits 20 enabled by the convolutions 22, the fluid conduits 20 are particularly advantageous in embodiments in which the frame 12 of the patient support system 10 is reconfigurable. By reconfigurable, it is meant that different portions, members, or components of the frame 12 are movable and/or rearrangable with respect to each other such that the frame 12 is able to transition between at least a first configuration and at least a second configuration. In such transitions, a distance between the first port 24 and the second port 26 may change, (e.g., be lengthened or shortened), due to various portions of the frame 12 moving relative to each other.

As illustrated throughout the Figures, the mattress 14 may be supportable on a mattress deck 30 of the frame 12. As shown in the exemplary embodiment, the mattress deck 30 may include a plurality of separate portions that are able to be articulated with respect to each other. For example, the mattress deck 30 of the patient support system 10 in the illustrated embodiment includes a calf portion 32*a* (e.g., a portion arranged and positioned to generally support a patient's calves), a thigh portion 32*b*, a seat portion 32*c*, and a head portion 32*d* (collectively, "the deck portions 32"). It is also contemplated that other deck portions may be utilized in other embodiments. By articulated, it is meant that the deck portions 32 may be rotated and/or positioned at different angles with respect to each other, (e.g., via joints 34 connecting adjacent ones of the deck portions 32). It is to be understood that the mattress deck 30 may include a lesser number of portions, such as a single portion extending the length of the mattress 14 that is not capable of articulation, or optionally a greater number of portions than described heretofore.

Figure 2:
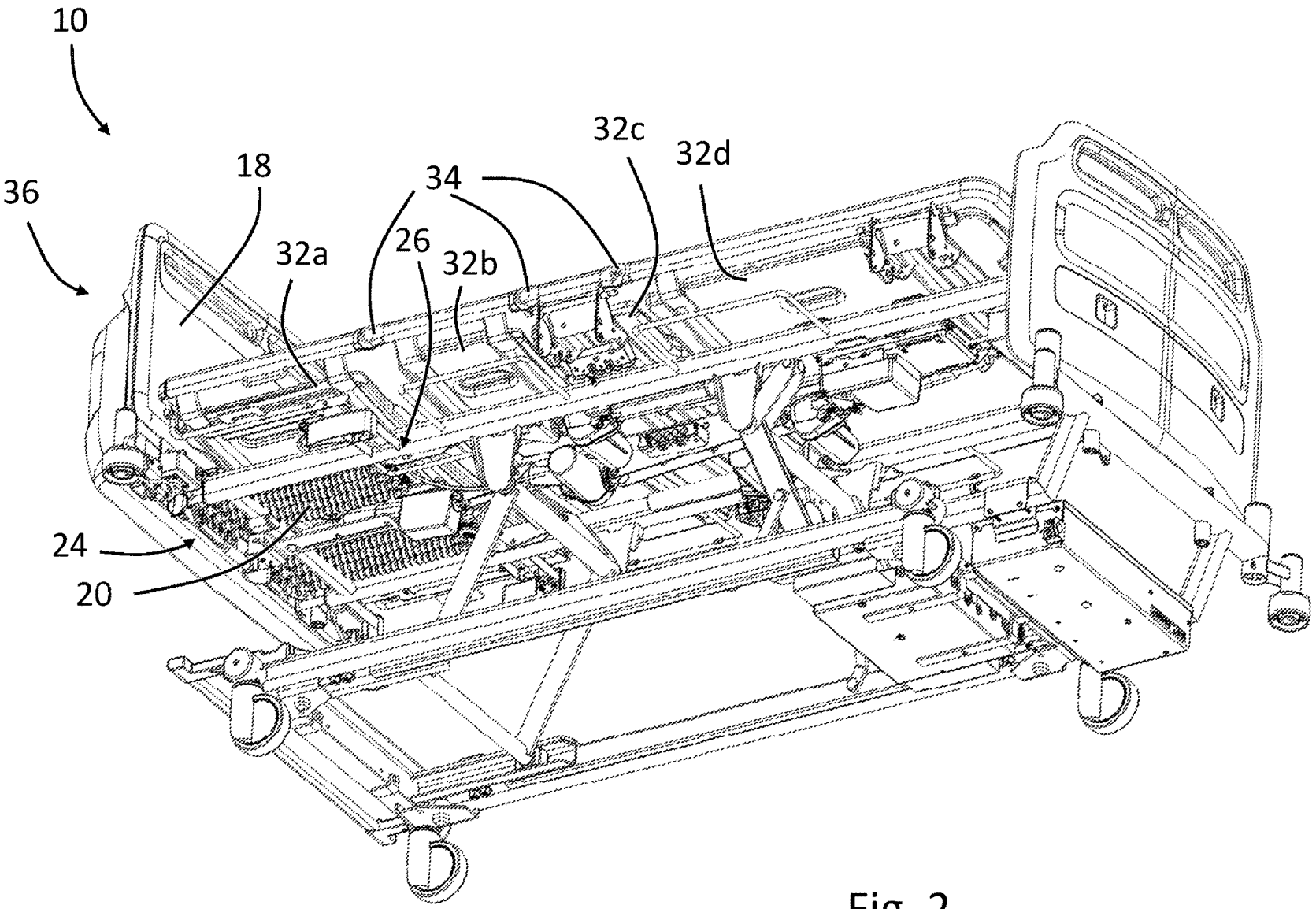
FIG. 2 is a perspective view of an underside of the patient support system of FIG. 1.
Figure 5:
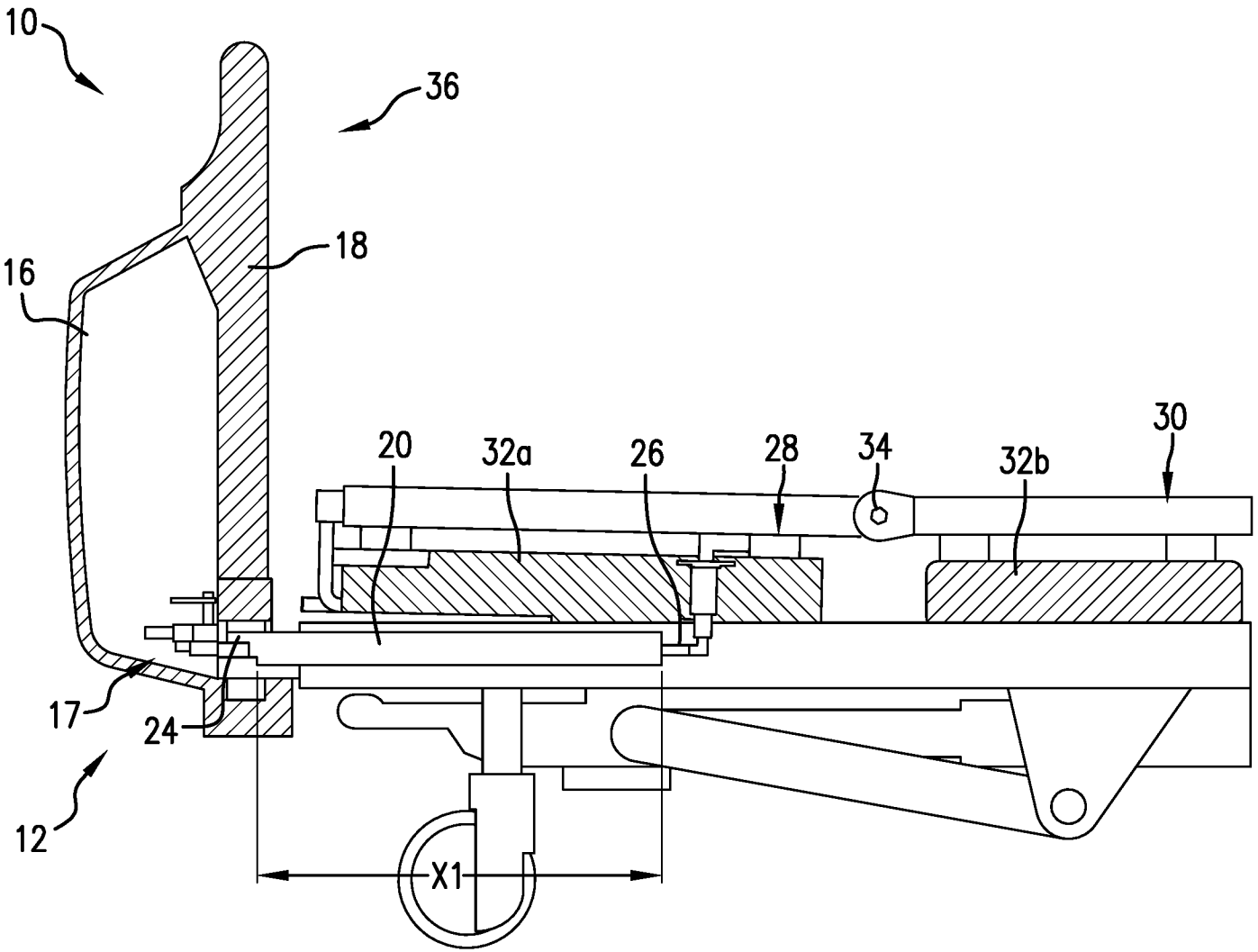
FIG. 5 is a partial cross-sectional view of the patient support system of FIG. 1, with a frame thereof in an initial configuration.
Figure 6:
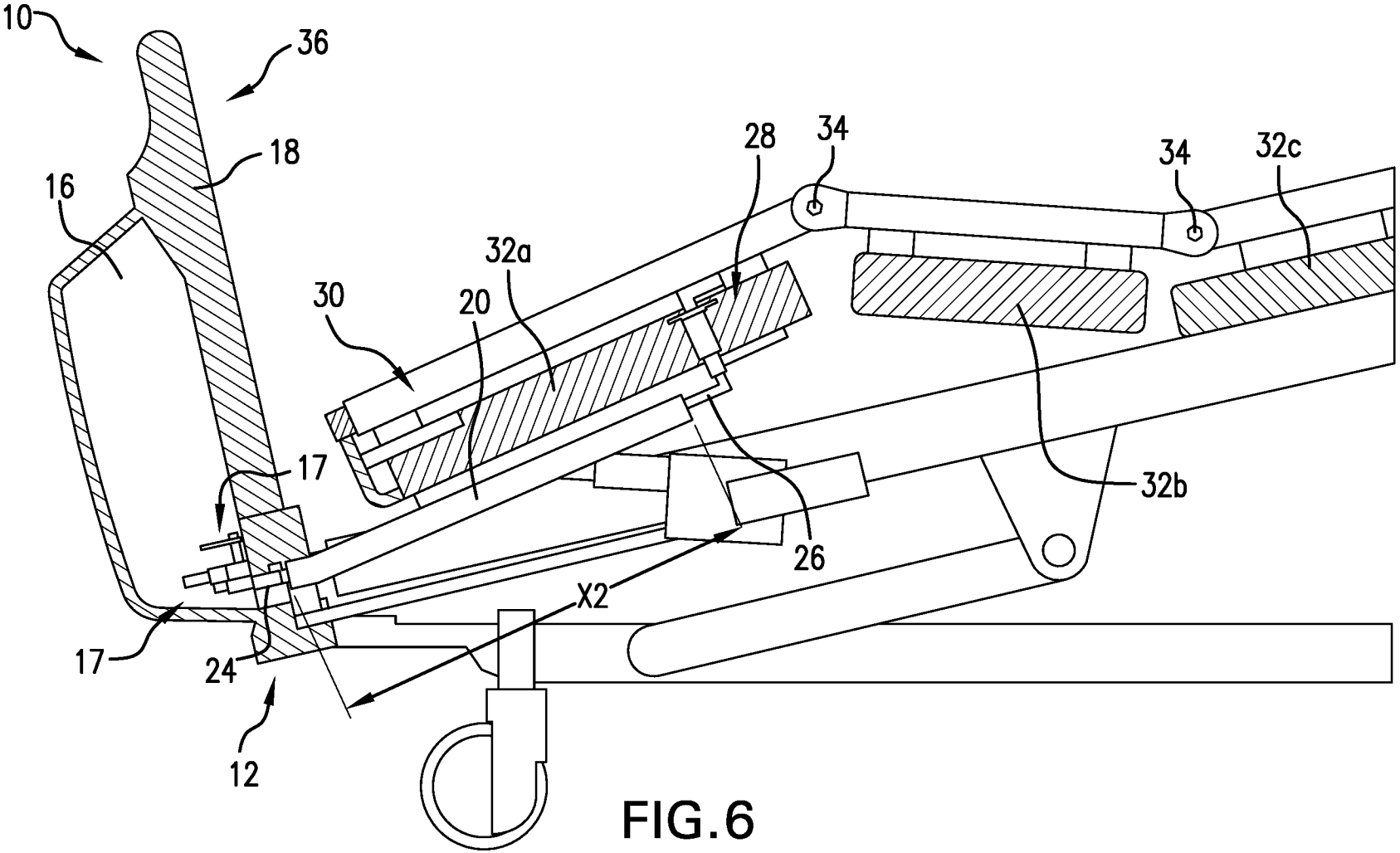
FIG. 6 is a partial cross-sectional view of the patient support system of FIG. 1, with the frame thereof in a tilted and articulated configuration.
Figure 7:
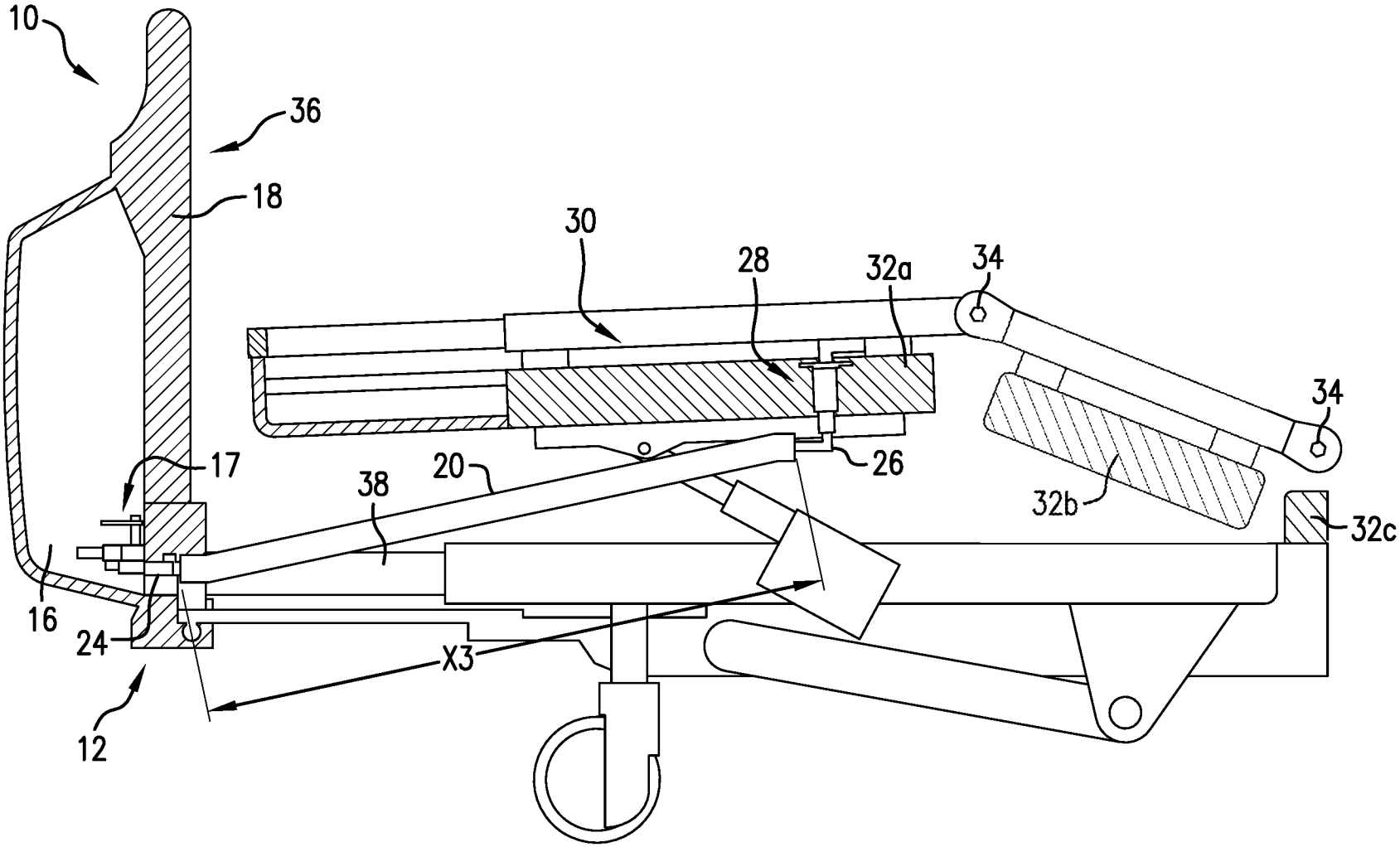
FIG. 7 is a partial cross-sectional view of the patient support system of FIG. 1, with the frame in an extended and articulated configuration.

The mattress deck 30 is shown with its portions 32 in a generally flat or level configuration in FIGS. 1, 2, and 5, and in articulated configurations in FIGS. 6 and 7. The outlet port 24 is formed with, mounted on, and/or connected to a foot portion 36 of the frame 12, which includes the footboard 18 and the fluid pressure supply unit 16. When the deck portions 32 are articulated, they may move relative to the foot portion 36, which may increase the distance between the port 24 and the port 26, and therefore may increase the corresponding length of the fluid conduit(s) 20. For example, a first distance X1 between the ports 24 and 26 when the frame 12 is in an unarticulated configuration is illustrated in FIG. 5. By transitioning the frame 12 to the articulated configuration of FIG. 6, the distance between the port 24 and the port 26 may be increased to a distance X2, which may be longer than the distance X1. The aforementioned transition of the frame 12 between its unarticulated configuration and its articulated configuration will cause a tensile force on the fluid conduits 20, which will result in the convolutions 22 opening, extending, or elongating, in order for the fluid conduits 20 to assume an increased length and maintain fluid communication between the mattress 14 and the fluid pressure supply unit 16.

As illustrated in another example, the frame 12 may be reconfigured by elongating the frame 12, which can be appreciated by comparing the configuration of the patient support system 10 in FIG. 5 with that of FIG. 7. More specifically, the foot portion 36 may be mounted on a telescoping member 38 of the frame 12. The telescoping member 38 may be any beam, bar, rod, arm, leg, or other structural component that is movable, (e.g., slidable), with respect to the remainder of the frame 12. For example, the telescoping member 38 may be a beam housed within a larger outer hollow beam, a beam arranged adjacent to and slidable on a track arranged on an adjacent beam, etc. It may be desired to elongate the frame 12, for example, if a larger mattress 14 is desired to accommodate tall patients. As illustrated in FIG. 7, elongating the frame 12 by way of the telescoping member 38 displaces the ports 24 and 26 away from each other, which increases the distance therebetween, as indicated by a reference numeral X3. Again, the convolutions 22 enable the length of the fluid conduits 20 to correspondingly extend or lengthen, such that fluid communication through the fluid conduits 20 is maintained even when the frame 12 is transitioned to an elongated configuration.

Those of ordinary skill in the art will appreciate that elongation and articulation are only two examples of reconfiguring that a frame may undergo, and that the fluid conduits 20 may be useful in any embodiment in which the distance between the fluid pressure supply (e.g., one or more outlet ports 24) and the ports or manifold assembly for a mattress (e.g., one or more the inlet ports 26) may change during the reconfiguring of a patient support system frame. Such additional examples may include for example combinations of both articulation and elongation. Additionally, it is to be understood that the distances X1, X2, and X3 are given as examples only for the sake of exemplification, and that the fluid conduits 20 may be arranged to stretch to any length between the distances X1 and X2 or the distances X2 and X3, and/or to lengths greater than the length X3. Additionally, even if the length X3 were the greatest distance between the ports 24 and 26 that is possible by reconfiguring the frame 12, that it may be desirable for the fluid conduits 20 to be selected such that they are capable of lengthening beyond this amount, thereby reducing the forces exerted on the couplings of the fluid conduits 20 to the ports 24 and/or 26.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A patient support system, comprising:

a frame including a first portion and a second portion, at least one of the first portion or the second portion is movable with respect to the other to transition the frame between a first configuration and a second configuration;

a first port coupled to the first portion of the frame, and a second port coupled to the second portion of the frame, wherein a distance between the first port and the second port changes when the frame transitions between the first and second configurations; and a fluid conduit arranged between the first port and the second port, the fluid conduit configured to transition between a first length and a second length, longer than the first length, when the frame is transitioned between the first and second configurations, wherein the fluid conduit is configured to naturally return toward the first length, wherein the first portion of the frame comprises a footboard and the fluid pressure supply unit is mounted to the footboard and in fluid communication with the fluid conduit via the first port, wherein the frame includes a telescoping member coupled to the footboard and configured to enable the frame to elongate in a longitudinal direction, such that the footboard is moved away from the second portion of the frame, in order to transition the frame between the first and second configurations, and wherein the fluid conduit is configured to extend in the longitudinal direction from the first length to the second length upon an elongation of the telescoping member.

2. The patient support system of claim 1, further comprising a fluid pressure supply unit configured to communicate fluid pressure through the fluid conduit.

3. The patient support system of claim 1, wherein the fluid pressure supply unit includes the first port.

4. The patient support system of claim 1, wherein the second portion of the frame comprises a mattress deck.

5. The patient support system of claim 4, further comprising a mattress supported on the mattress deck and in fluid communication with the fluid conduit via the second port.

6. The patient support system of claim 5, wherein the mattress deck comprises a plurality of portions that are configured to articulate with respect to each other to transition the frame between the first and second configurations.

7. The patient support system of claim 1, wherein the first portion of the frame comprises a mattress deck.

8. The patient support system of claim 7, wherein the mattress deck comprises multiple portions that are configured to articulate with respect to each other to transition the frame between the first and second configurations.

9. The patient support system of claim 1, wherein the patient support system further comprises a bed.

10. The patient support system of claim 1, wherein a length of the fluid conduit is configured to be extendable up to at least about two times an unstressed configuration.

11. The patient support system of claim 1, wherein the fluid conduit comprises a plurality of convolutions.

12. The patient support system of claim 11, wherein the convolutions are arranged in an axially adjacent manner to form the fluid conduit.

13. The patient support system of claim 11, wherein an axial dimension of each of the convolutions is variable in response to different forces exerted on each of the convolutions, which variable axial dimension enables the fluid conduit to transition between the first length and the second length.

14. A method of using a patient support system comprising:

reconfiguring a frame of the patient support system by causing relative movement between a first portion and a second portion of the frame in order to transition the frame between a first configuration and a second configuration;

changing a distance between a first port disposed with the first portion of the frame and a second port disposed with the second portion of the frame due to the transition between the first and second configurations;

changing a length of a fluid conduit arranged between the first port and the second port when the frame is transitioned between the first and second configurations, wherein the fluid conduit is arranged to naturally return toward an initial length after tensile forces exerted on the fluid conduit are relieved; and maintaining fluid communication between the first port and the second port via the fluid conduit after changing the length of the fluid conduit, wherein the first portion includes a footboard of the frame and a fluid pressure supply unit mounted to the footboard, wherein the frame includes a telescoping member coupled to the footboard and configured to enable the frame to elongate in a longitudinal direction, such that the footboard is moved away from the second portion of the frame, in order to transition the frame between the first and second configurations, and wherein the fluid conduit is configured to extend in the longitudinal direction from a first length to a second length, which is longer than the first length, upon an elongation of the telescoping member.

15. The method of claim 14, wherein the first portion is connected to the second portion by a telescoping member that is movable with respect to the second portion, and reconfiguring the frame includes elongating the frame by moving the first portion and the second portion away from each other via the telescoping member.

16. The method of claim 14, wherein the patient support system further comprising a joint coupled to the first portion and wherein reconfiguring the frame includes articulating the first portion relative to the second portion.

17. The method of claim 14, further comprising a mattress deck that is at least partially comprised by the first portion.

* * * * *